US008916801B2

(12) United States Patent
Harward et al.

(10) Patent No.: US 8,916,801 B2
(45) Date of Patent: Dec. 23, 2014

(54) HOUSEHOLD APPLIANCE HAVING SUPPORTS SUPPORTING A GLASS HEATING ELEMENT OF A WARMING DRAWER

(75) Inventors: Samuel Harward, Knoxville, TN (US); Rose Marie Parker, Caryville, TN (US); Sibyl Perkins, LaFollette, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 282 days.

(21) Appl. No.: 13/483,094

(22) Filed: May 30, 2012

(65) Prior Publication Data

US 2013/0319996 A1 Dec. 5, 2013

(51) Int. Cl.

| | |
|---|---|
| ***F24C 7/06*** | (2006.01) |
| ***F24C 15/18*** | (2006.01) |
| ***H05B 3/22*** | (2006.01) |
| ***H05B 3/26*** | (2006.01) |
| ***H05B 3/74*** | (2006.01) |
| ***H05B 3/68*** | (2006.01) |

(52) U.S. Cl.

CPC ..... *F24C 15/18* (2013.01); *H05B 3/748* (2013.01); *F24C 7/06* (2013.01); *H05B 3/68* (2013.01); *H05B 3/265* (2013.01); *H05B 3/746* (2013.01)

USPC ..... 219/385; 219/451.1; 219/521; 219/536; 219/543; 219/548

(58) Field of Classification Search

CPC ..... H05B 1/0294; H05B 3/265; H05B 3/68; H05B 3/74; H05B 3/746; H05B 3/748; H05B 2203/013; H05B 2203/016; H05B 2203/028; H05B 2203/033; F24C 7/06; F24C 7/083; F24C 15/102; F24C 15/104; F24C 15/105; F24C 15/18

See application file for complete search history.

(56) References Cited

U.S. PATENT DOCUMENTS

| | | | | |
|---|---|---|---|---|
| 2,976,386 | A * | 3/1961 | Salton | 219/450.1 |
| 3,883,719 | A * | 5/1975 | Hurko | 219/466.1 |
| 3,941,117 | A | 3/1976 | Pei et al. | |
| 3,987,275 | A * | 10/1976 | Hurko | 219/451.1 |
| 4,068,115 | A * | 1/1978 | Mack et al. | 219/386 |
| 5,038,018 | A * | 8/1991 | Grise et al. | 219/213 |
| 5,198,638 | A * | 3/1993 | Massacesi | 219/209 |
| 5,276,310 | A * | 1/1994 | Schmidt et al. | 219/521 |
| 5,508,495 | A * | 4/1996 | Yahav et al. | 219/466.1 |
| 5,653,905 | A * | 8/1997 | McKinney | 219/400 |
| 5,786,568 | A * | 7/1998 | McKinney | 219/400 |
| 5,841,109 | A | 11/1998 | White et al. | |
| 6,037,572 | A * | 3/2000 | Coates et al. | 219/451.1 |
| 6,191,391 | B1 | 2/2001 | Deo et al. | |
| 6,384,380 | B1 * | 5/2002 | Faries et al. | 219/385 |
| 7,009,151 | B2 * | 3/2006 | Lee | 219/460.1 |

(Continued)

*Primary Examiner* — Joseph M Pelham

(74) *Attorney, Agent, or Firm* — James E. Howard; Andre Pallapies

(57) ABSTRACT

A household appliance includes a warming drawer housing having an interior chamber, and a warming drawer module being movable between a first position in which the warming drawer module is in the interior chamber of the warming drawer housing and a second position in which a part of the warming drawer module is outside the warming drawer housing. The warming drawer module includes a heating element forming a floor surface of the warming drawer module and a support plate that supports the heating element in the warming drawer module. The support plate includes a plurality of supports supporting an underside of the heating element.

39 Claims, 13 Drawing Sheets

(56) References Cited

U.S. PATENT DOCUMENTS

| | | | | |
|---|---|---|---|---|
| 7,170,035 | B2 * | 1/2007 | Peterson et al. | 219/386 |
| 7,208,700 | B2 * | 4/2007 | Peterson et al. | 219/386 |
| 7,235,762 | B2 * | 6/2007 | Gagas et al. | 219/400 |
| 7,279,659 | B2 * | 10/2007 | Gagas et al. | 219/400 |
| 7,328,654 | B2 * | 2/2008 | Shei | 99/468 |
| 7,420,140 | B2 * | 9/2008 | Lenhart et al. | 219/412 |
| 7,488,919 | B2 * | 2/2009 | Gagas et al. | 219/400 |
| 7,619,182 | B2 * | 11/2009 | Morrow et al. | 219/391 |
| 8,538,249 | B2 * | 9/2013 | Shaffer et al. | 392/422 |
| 2005/0274712 | A1 * | 12/2005 | Gagas et al. | 219/494 |
| 2006/0043087 | A1 * | 3/2006 | Gagas et al. | 219/391 |
| 2006/0049172 | A1 * | 3/2006 | Gagas et al. | 219/521 |
| 2006/0278629 | A1 * | 12/2006 | Gagas et al. | 219/385 |

* cited by examiner

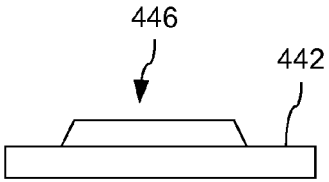
FIG. 10A
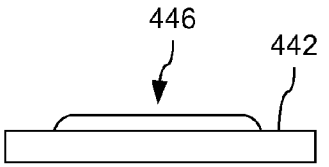
FIG. 10B
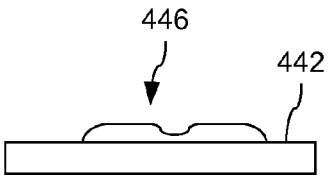
FIG. 10C
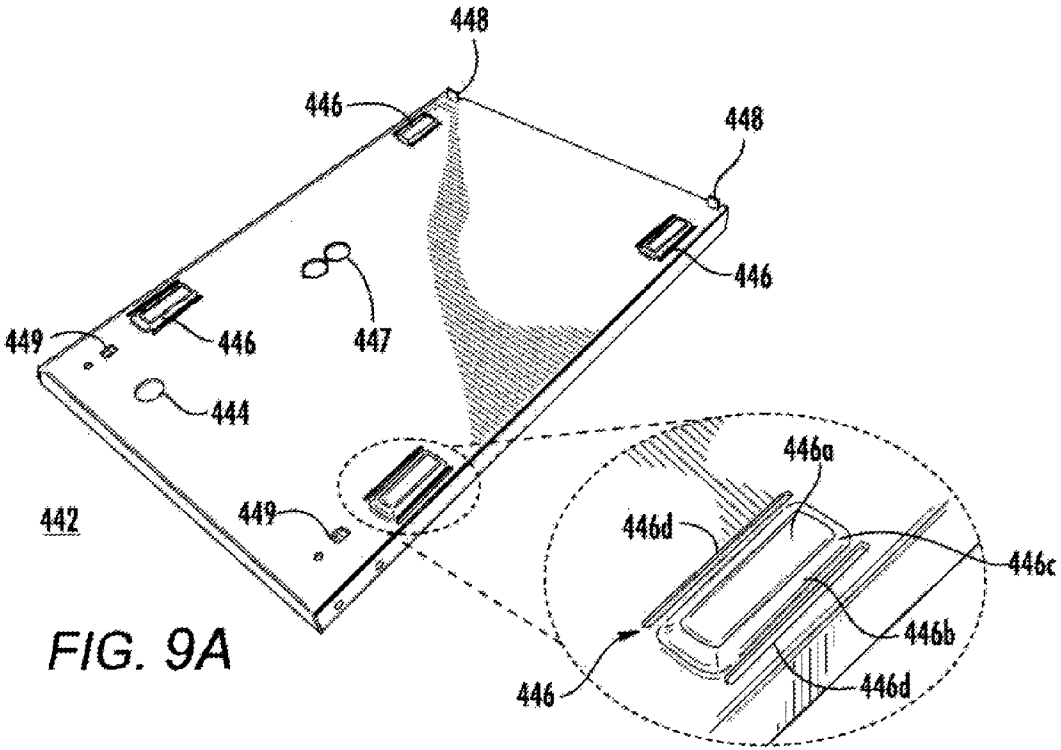
FIG. 9A
FIG. 9B

HOUSEHOLD APPLIANCE HAVING SUPPORTS SUPPORTING A GLASS HEATING ELEMENT OF A WARMING DRAWER

CROSS-REFERENCES TO RELATED APPLICATIONS

This application is related to Applicants' co-pending U.S. applications, which are filed concurrently herewith, entitled "HOUSEHOLD APPLIANCE HAVING A DEPLOYABLE WARMING DRAWER MODULE", Ser. No. 13/483,098; "HOUSEHOLD APPLIANCE HAVING A WARMING DRAWER WITH A THERMALLY CONDUCTIVE LAYER", Ser. No. 13/483,097; "HOUSEHOLD APPLIANCE HAVING A DRIP GUARD FOR A WARMING DRAWER", Ser. No. 13/483,096; and "HOUSEHOLD APPLIANCE HAVING A THERMOSTAT RETAINER FOR A THERMOSTAT OF A WARMING DRAWER", Ser. No. 13/483,092, each of which is incorporated herein by reference in its entirety.

FIELD OF THE INVENTION

The present invention is directed to a household appliance having a warming drawer, and more particularly, to a household appliance having a plurality of supports supporting a heating element of a warming drawer, and more particularly, to a household appliance having a plurality of embosses supporting a glass heating element of a warming drawer.

BACKGROUND OF THE INVENTION

Some conventional household appliances may include a warming drawer for warming one or more items P such as food, cookware, cutlery, etc. or maintaining a predetermined temperature of the items. As shown for example in FIG. 1, a conventional warming drawer 1 commonly may include a housing 2 and a drawer 4 having four walls 6, a floor 8, and a handle 10, similar to an ordinary drawer. The drawer 4 may be slidably coupled to the housing 2 by ordinary drawer slides 12 mounted on the interior sidewalls of the housing 2 or to the floor of the housing 2. The functional parts of the warming drawer commonly are attached to the housing 2 of the warming drawer 1. For example, a heating element 14 commonly is fixed to the interior of the housing 2, such as on the floor of the housing 2. In operation, the drawer 4 moves over the heating element 14 when the drawer 4 is in a closed position inside the housing 2 to heat the items P in the drawer 4. The controls (not shown) for the conventional warming drawer commonly are provided on the warming drawer housing 2 or on the housing of the appliance.

SUMMARY OF THE INVENTION

The conventional warming drawer having a heating element fixed to the interior of the housing and the warming drawer moving over the heating element when the warming drawer is moved to a closed position may have limited or reduced heat transfer between the heating elements and the warming drawer and the contents of the warming drawer and the heat transfer may vary for different positions in the drawer, thereby resulting in hot spots in the drawer. Assembly and repair work for components of such a warming drawer commonly may be difficult to perform particularly where the appliance is installed in cabinetry. The assembly of the parts of the warming drawer within the warming drawer housing during manufacturing also can be complex and time-consuming.

To solve the foregoing problems, a warming drawer has been provided in which functional parts of the warming drawer are assembled together into a sub-assembly or warming drawer module that easily can be inserted and removed from the warming drawer housing by manufacturing personnel, a user, or a repair technician. A heating device may be coupled to and movable with the warming drawer module in and out of the housing. In this way, the warming drawer module can improve heat transfer, and provide more uniform and predictable heat transfer, between the heating element and the contents of the warming drawer module, thereby providing uniform heating at various positions in the drawer and reducing or eliminating hot spots in the warming drawer module. The warming drawer module also can simplify and improve the ease with which assembly and repair work can be performed for components of the warming drawer by enabling the warming drawer module to be removed from the warming drawer housing with a simple connection such that a user or technician can easily and simply perform repairs, replacement, and/or cleaning without having to remove the warming drawer housing. Electrical and control wires and cable, as well as wire and cable routing features, also may be coupled to or included in the deployable warming drawer module so that manufacturing personnel, a user, or a repair technician do not have to route wires or cables when installing and/or removing the warming drawer module.

The heating device of the warming drawer module may be provided by a heating element, such as a ceramic/glass heating element, that forms a floor surface of the module for receiving the items to be warmed and that provides uniform heat across the entire floor surface of the warming drawer, while also being easy to clean and providing an aesthetically pleasing appearance, for example, when the drawer is deployed form the warming drawer housing. In this case, the underside of the glass commonly has a thin metal layer or conductive coating (e.g. a clear, even conductive coating) which, when supplied with an electric current, generates heat evenly across the entire surface of the ceramic/glass heating element. As a result, the entire surface of the ceramic/glass heating element can generate heat and form a portion of an electric circuit.

The present invention recognizes that, since the ceramic/glass heating element forms the floor of the warming drawer module and will be directly loaded with plates, cookware, cutlery, food, etc., the underside of the ceramic/glass heating element must be sufficiently supported to minimize or prevent damage to the ceramic/glass heating element from the force (e.g., weight) of the items being exerted on the upper surface of the ceramic/glass heating element. Additionally, the present invention recognizes that, since the ceramic/glass heating element functions both as a floor surface and as a heated surface for warming the items, and since the underside of the entire ceramic/glass heating element forms part of the electric circuit, the ceramic/glass heating element will need to be supported in a manner that protects the heating element while also minimizing heat transfer away from the ceramic/glass heating element downward and away from the items (which is an undesired direction for heat transfer for the warming drawer) and correspondingly minimizing an amount of contact area that needs to be electrically insulated from the underside of the glass/ceramic heating element.

The present invention provides simple, easy to manufacture, and inexpensive support means for providing sufficient support underneath such a ceramic/glass heating element to minimize or prevent damage to the ceramic/glass heating element and simultaneously minimize a contact area between the ceramic/glass heating element and the support means, which correspondingly can minimize heat transfer away from the ceramic/glass heating element downward (toward the support plate) and minimize an amount of insulation needed to insulate the contact area between the underside of the glass/ceramic heating element and the support plate.

An exemplary embodiment is directed to a support plate, and a warming drawer having a support plate, including support means for supporting an underside of the glass/ceramic heating element such that the heating element will not be damaged by items loaded on the glass/ceramic heating element (i.e., glass/ceramic floor surface) of the warming drawer module. The support means can minimize an amount of a thermal and/or electrical contact area between the support means and the underside of the glass/ceramic heating element. For example, the support means can simultaneously minimize an amount of contact between that support means and the underside of the glass/ceramic heating element to minimize heat transfer away from the glass/ceramic heating element downward (i.e., an undesired direction for heat transfer) and to minimize an amount of contact area that will need to be electrically insulated from the underside of the glass/ceramic heating element. The support means can control a height of the glass/ceramic heating element above a surface of a support plate (i.e., suspend the heating element above the support plate) to provide a predetermined height or clearance for a thermostat and thermostat retainer to be disposed under the glass/ceramic heating element and in contact with the underside of the glass/ceramic heating element. By controlling the height of the glass/ceramic heating element above the surface of a support plate, the support means also can provide sufficient space for wire routing between the glass/ceramic heating element and the metal support plate.

More particularly, an exemplary embodiment is directed to a support plate having one or more supporting means or support features, such as a plurality of embosses for supporting (e.g., evenly and distributively supporting) an underside of the glass/ceramic heating element at a predetermined distance above the support plate, while also minimizing thermal and electrical contact areas between the heating element and the support plate. The support plate can include a metal support plate, such as a stainless steel support plate or other suitable heat resistant material, that is capable of being embossed using an emboss tool. In this way, the supports, such as embosses, can be formed easily and inexpensively on the surface of the support plate with precision and consistency in the manufacturing process. The dimensions (e.g., height) of the supports (e.g., embosses) can be easily controlled using common manufacturing processes. In other embodiments, the support plate can be formed from other materials, for example, such as heat resistant materials that are capable of being formed by embossing, casting, or molding processes. The supports (e.g., embosses) can control a height of the glass/ceramic heating element above a surface of the support plate to provide a predetermined height or clearance for routing wires between the glass/ceramic heating element and the metal support plate.

The supports (e.g., embosses) of the support plate can have a variety of shapes and/or profiles that are capable of supporting the underside of the glass heating element. Each support (e.g., emboss) can include, for example, an upper surface (e.g., having a substantially horizontal planar surface) for supporting the underside of the glass/ceramic heating element, a plurality of side surfaces (e.g., tapered or rounded side surfaces), and a plurality of tapered or rounded corners. A support (e.g., emboss) also can include one or more cutouts formed along one or more sides (e.g., a longer side) of the support (e.g., emboss), for example, to relieve stresses in the support plate during the formation of the emboss, which may prevent deformation of the surface of the support plate surrounding the support (e.g., emboss) during fabrication. When viewed from above (i.e., in a direction normal to the surface of the support plate and heating element), the support (e.g., emboss) can be, for example, rectangular-shaped embosses, square-shaped embosses, circular-shaped embosses, oval-shaped embosses, triangular-shaped embosses, among other shapes. When viewed from a side (e.g., in a direction parallel to a plane of the surface of the support plate and heating element), the support (e.g., emboss) can include, for example, a substantially planar, horizontal upper surface to distribute forces between the support (e.g., emboss) and the underside of the heating element. In other embodiments, the side profile of the support (e.g., emboss) can have other shapes, such as a round shape. The support (e.g., emboss) can include angled, tapered, or rounded/curved corners and/or sides to protect the underside of the glass/ceramic heating element from damage. In other embodiments, a support (e.g., emboss) can be separately formed in a single shape, or include a plurality of adjacent shapes, such as a support (e.g., emboss) formed from a series of shapes/profiles. The exemplary embodiments can provide a simple support (e.g., emboss) shape/profile that can be easily fabricated using a simple tool (e.g., a simple emboss tool), thereby reducing manufacturing costs compared to more complex and/or less uniform shaped features, while providing more precision and consistency in the manufacturing process and the resulting dimensions (e.g., height) of the support (e.g., emboss), and hence, the distance between the support plate and the underside of the glass/ceramic heating element.

The plurality of supports (e.g., embosses) can be disposed in various arrangements, patterns, and distributions on the support plate to support the heating element depending on the size, shape, and arrangement of the heating element. For example, one or more supports (e.g., embosses) can be disposed adjacent to a respective corner of the support plate. The supports (e.g., embosses) can be evenly spaced with respect to each other such that the supports (e.g., embosses) provide equal support for each of the edges of the glass heating element near the corners of the heating element, in the area in which a frame will clamp down on the heating element, thereby reducing or preventing damage to a glass/ceramic heating element, for example, during assembly of the warming drawer module.

In another exemplary embodiment, the support plate can include a plurality of supports (e.g., embosses) disposed along or adjacent to a longitudinal edge of one or more sides of the support plate. The supports (e.g., embosses) can be equally spaced along each edge or unequally spaced. The supports (e.g., embosses) can be disposed at, or adjacent to, a midpoint of a length of an edge, for example, in an instance in which one side of the heating element (e.g., glass/ceramic heating element) is longer (e.g., substantially longer) than another side to thereby prevent the heating element from flexing at the middle when supporting items such as food, plates, etc., in a loaded state. The supports (e.g., embosses) can be disposed at, or adjacent to, a midpoint of a length of the support plate, thereby preventing sagging or flexing of the heating element in a middle. In another exemplary embodiment, when viewed from above (i.e., in a direction normal to the surface of the support plate and heating element), the supports (e.g., embosses) can be disposed at different positions with respect to the corners, edges, or other features of the support plate, for example, such as parallel, perpendicular, or at another angle to the corner, edge, or other feature.

The exemplary embosses are not limited to a particular shape or layout, etc, and can include a plurality of shapes, sizes, profiles, configurations, and layouts on the support surface. For example, the support plate optionally can include one or more rectangular-shaped supports, square-shaped supports, circular-shaped supports, oval-shaped supports, and/or triangular-shaped supports, among other shapes. The supports can be formed in a symmetric layout on the support plate or a non-symmetric layout, depending on the particular size and shape of the heating element and the type or construction of the heating element (e.g., a glass/ceramic heating element).

In other embodiments, the support plate can include a plurality of supports (e.g., embosses) configured to support one or more heating elements, for example, in a side-by-side arrangement on the support plate 442.

The exemplary embodiments can provide a support plate for a glass/ceramic heating element of a deployable warming drawer or other device, having a plurality of supports (e.g., embosses) for supporting the heating element above the support plate, thereby minimizing a thermal contact area and electrical contact area, which may make it easier to insulate the heating element from the support plate and other components of the warming drawer. Moreover, the exemplary supports (e.g., embosses) accurately can control a height of the heating element above the support plate, which can ensure proper spacing and contact between the sensors of thermostats sandwiched between the support plate the underside of the glass heating element. The exemplary supports (e.g., embosses) also can elevate the glass heating element such that wires for the glass heating element can be run in a space between the glass heating element and the metal support plate. The exemplary embodiments of the present invention may simplify the manufacturing process and reduce labor and time for manufacturing, thereby reducing manufacturing costs.

In other embodiments, a household appliance can include a warming drawer with a fixed glass heating element. The warming drawer can include a support plate) having support means (e.g., a plurality of supports, such as embosses) supporting an underside of the heating element at a predetermined distance above the support plate.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein:

FIG. 9A is a perspective view of a support plate according to an exemplary embodiment of the invention, and FIG. 9B is an enlargement of a portion of the support plate in FIG. 9A.

FIGS. 10A-10C are schematic partial side views of emboss profiles according to exemplary embodiments of the invention.

DETAILED DESCRIPTION OF THE EXEMPLARY EMBODIMENTS OF THE INVENTION

Figure 1:
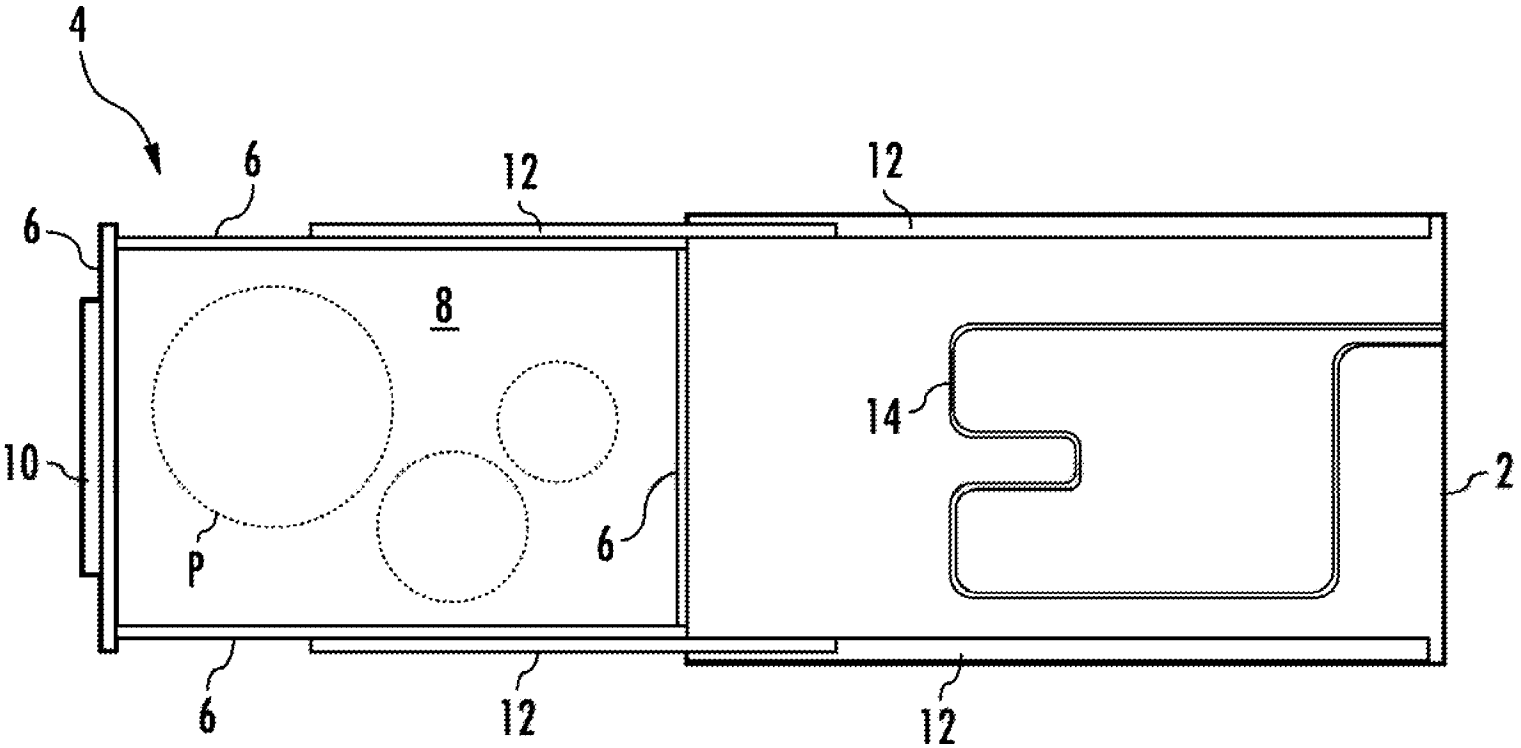
FIG. 1 PRIOR ART
FIG. 1 is a plan view of a conventional household appliance having a warming drawer.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 2-13B illustrate exemplary embodiments of a household appliance having a warming drawer.

Figure 2:
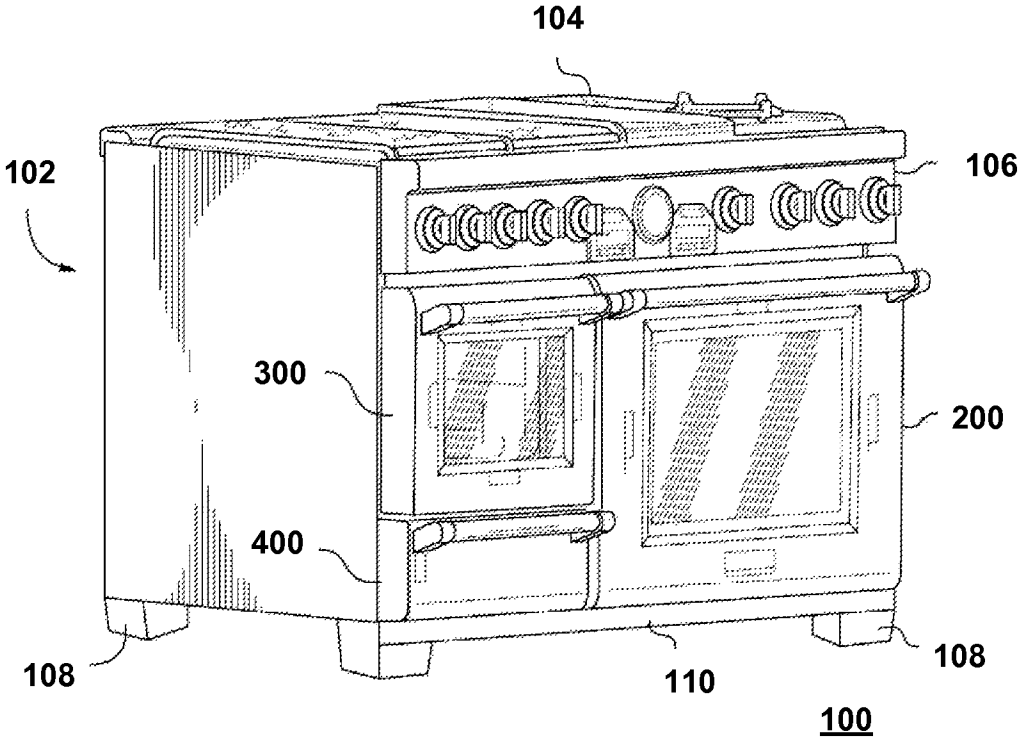
FIG. 2 is a perspective view of a household appliance according to an exemplary embodiment of the invention.

With reference to FIG. 2, an exemplary household appliance 100 can include a cooking range having a housing 102 including one or more cooking or warming devices, such as a cooktop, gas oven, electric oven, steam oven, convection oven, and/or warming drawer. In other embodiments, the appliance 100 can include one or more oven cooking chambers without a cooktop. In other embodiments, the appliance 100 can include a standalone appliance, wall mounted appliance, or countertop appliance, such as a stand-alone warming drawer, wall mounted warming drawer, or countertop warming drawer. The appliance housing 102 can include, for example, a cooktop 104 and control panel 106. The cooktop 104 can include, for example, a gas cooktop having a plurality of gas burners, or other types of cooktops, such as an electric cooktop, an induction cooktop, or the like. The exemplary household appliance 100 can include one or more doors, such as a baking oven door 200, a steam oven door 300, and/or a warming drawer door 400 for providing access to one or more chambers of the housing 102. The housing 102 can include pedestal feet 108 for example for supporting the stand alone appliance and a kick panel 110.

Figure 3:
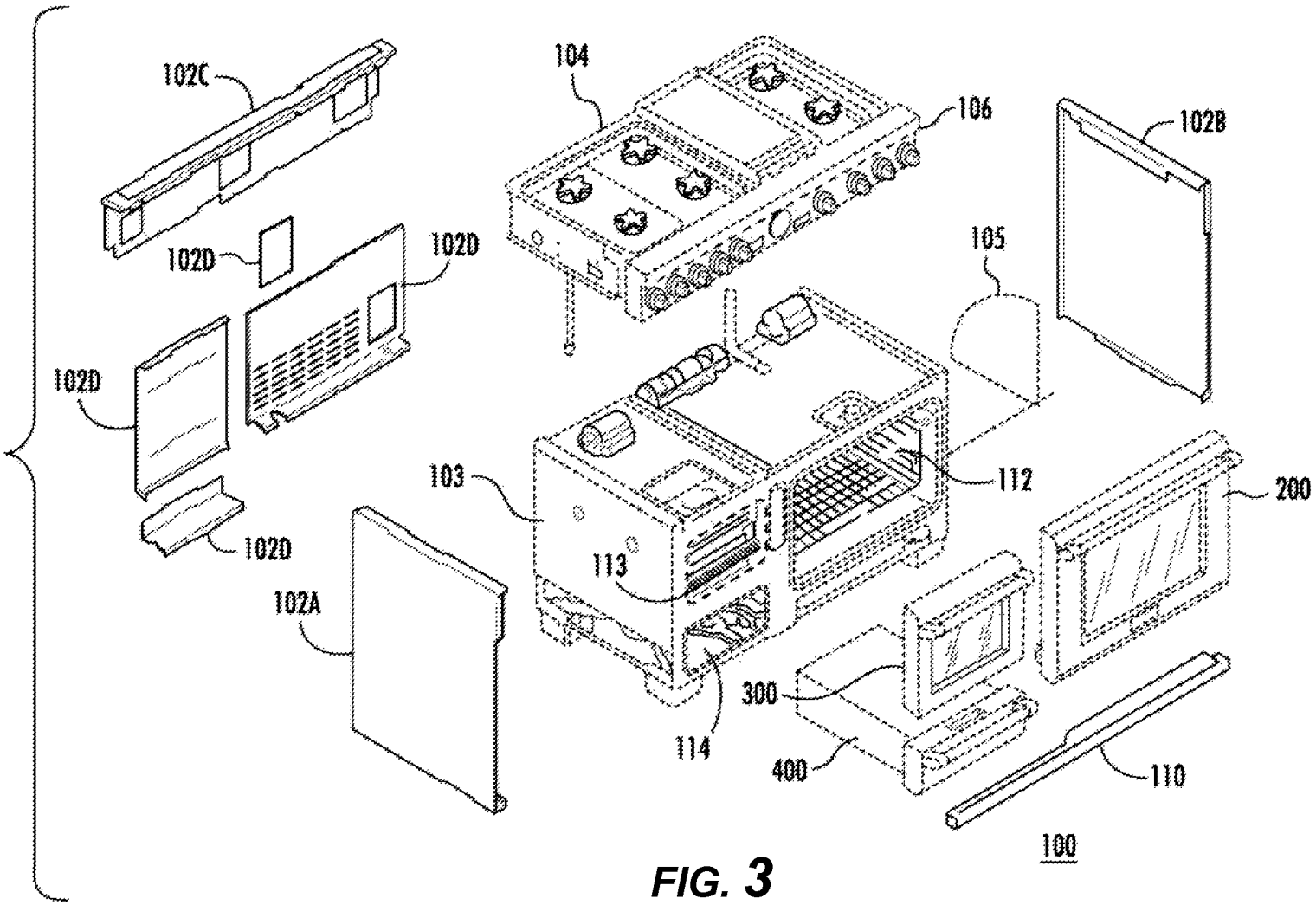
FIG. 3 is an exploded view of a household appliance according to an exemplary embodiment of the invention.

Referring to FIG. 3, the housing 102 of the exemplary household appliance 100 shown in FIG. 2 further can include, for example, left-hand and right-hand sidewalls 102A, 102B and one or more rear panels 102D on a frame 103. The exemplary appliance 100 can include other devices and features, such as, for example, a backsplash 102C, hideaway label plate 105, etc. The frame 103 can include one or more chambers for cooking or warming devices, such as a baking oven chamber 112, steam oven chamber 113, and/or warming drawer chamber 114.

Figure 4:
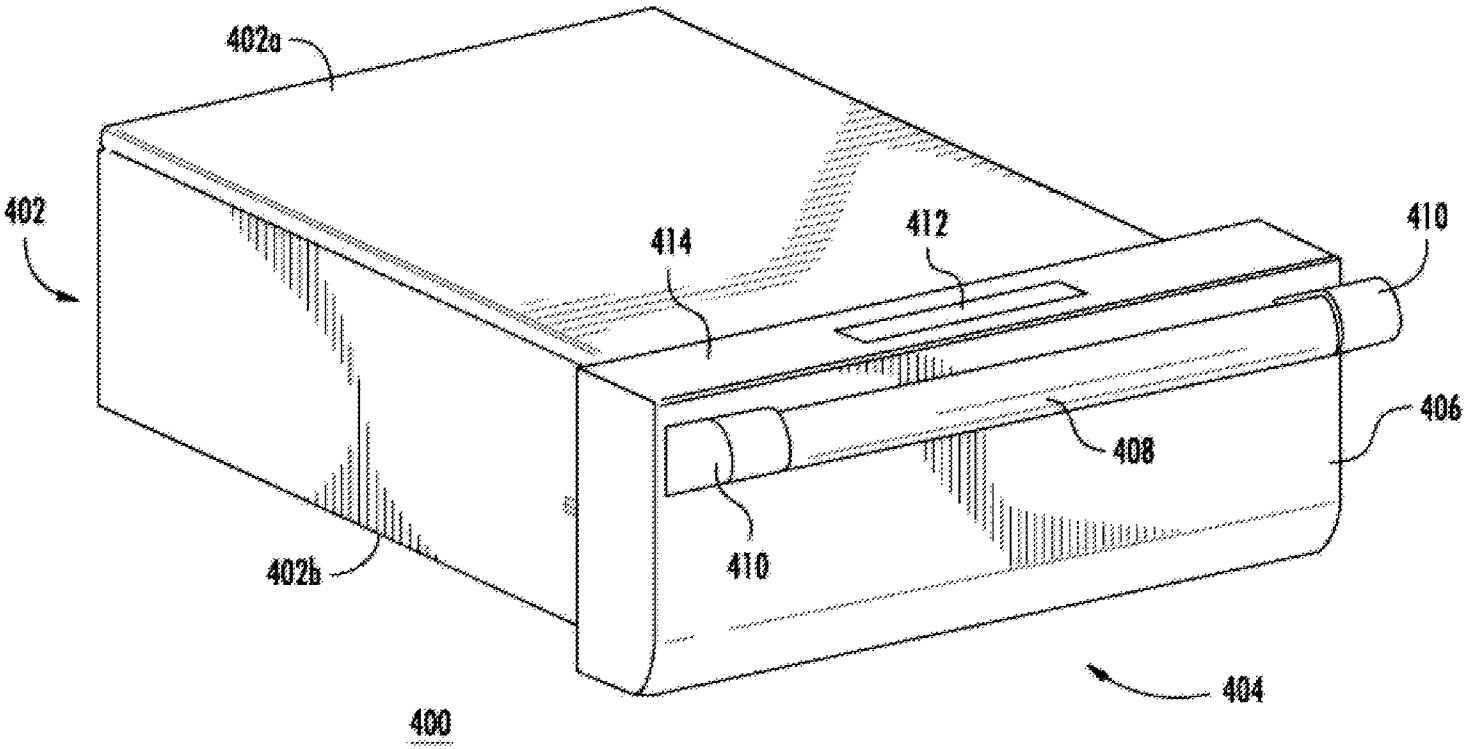
FIG. 4 is a perspective view of a warming drawer according to an exemplary embodiment of the invention.

With reference to FIG. 4, an exemplary embodiment of a modular warming drawer 400 will now be described in which the functional components of the warming drawer are deployable from within a fixed warming drawer housing.

Figure 6:
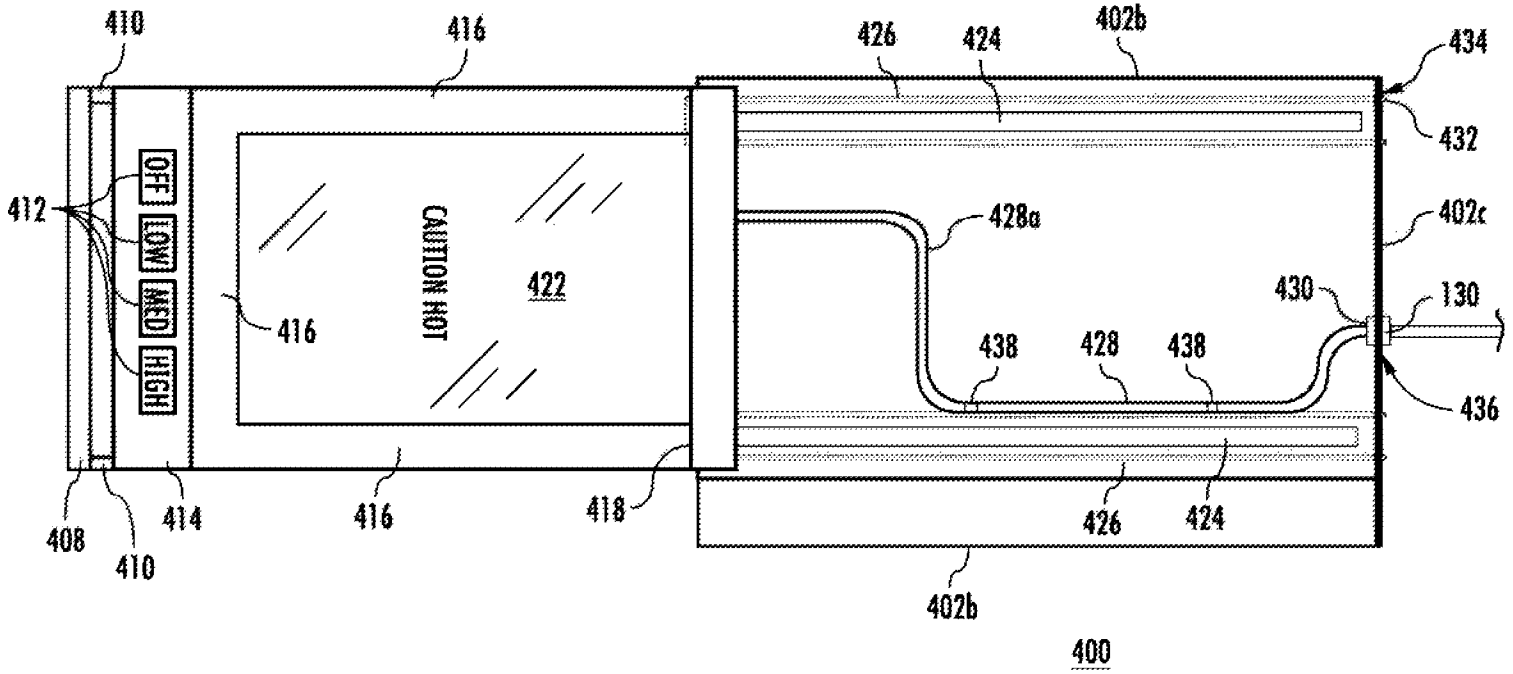
FIG. 6 is a plan view of a warming drawer having a deployed warming drawer module according to an exemplary embodiment of the invention.

The modular warming drawer 400 can include, for example, a fixed warming drawer housing 402 having a top 402*a*, a bottom (not visible in FIG. 4), sidewalls 402*b*, and a rear wall (not visible in FIG. 4). The top, bottom, sidewalls, and/or rear wall of the warming drawer housing 402 can be, for example, stainless steel panels. The warming drawer housing 402 can be disposed in the warming drawer chamber 114 shown in FIG. 3. The modular warming drawer 400 can include, for example, a deployable warming drawer module 404 having a front panel 406, a handle 408 coupled to the front panel 406 via, for example, handle mounts 410. The front panel 406 and other portions thereof can include, for example, one or more stainless steel panels. The deployable warming drawer module 404 can include, for example, a control panel 412 for controlling the functions of the warming drawer module 404. The control panel 412 can be, for example, a concealed control panel on or recessed within the upper surface 414 of the front panel 406, which is visible to a user only when the warming drawer module 404 is in a deployed position, as illustrated in FIG. 6 described in greater detail below. In other embodiments, the control panel 412 can be on or recessed within the face of the front panel 406 or a side of the front panel 406. The control panel 412 can include, for example, one or more touch-activated switches for controlling an operation of the warming drawer 400, such as, for example, an 'OFF' setting, a 'LOW' setting, a 'MED' setting, and a 'HIGH' setting.

Figure 5:
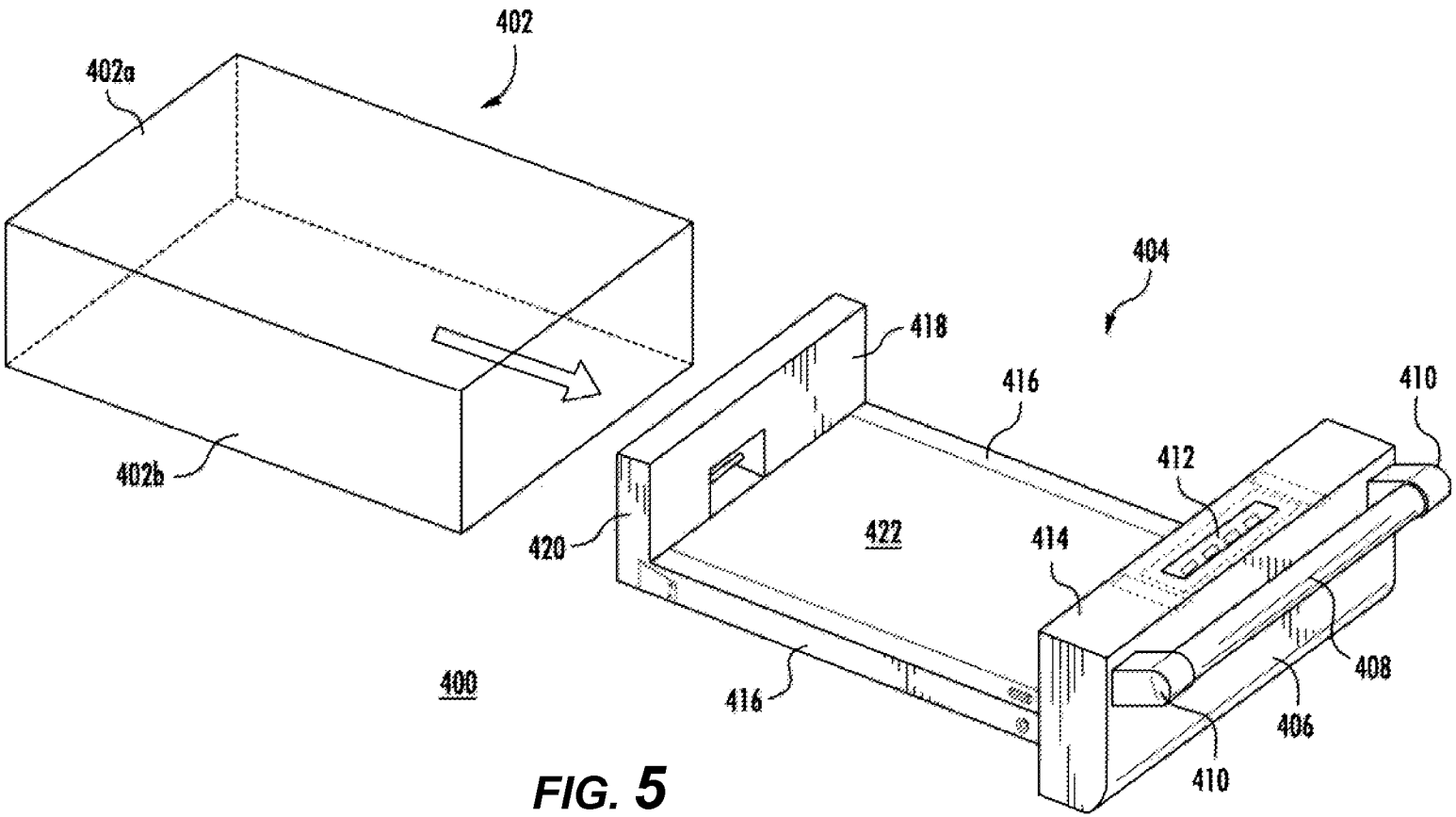
FIG. 5 is a partially exploded perspective view of a warming drawer according to an exemplary embodiment of the invention.

With reference to FIGS. 5 and 6, the exemplary warming drawer module 404 can include a frame 416 coupled to the front panel 406, and a rear panel 418 coupled to an opposite end of the frame 416, for example, via a bracket portion 420 (which may be formed separately or integrally with the rear panel 418). The exemplary warming drawer module 404 can include a heating device, such as a sheet glass or glass/ceramic heating element 422, which is disposed in or supported by the frame 416. The sheet glass or glass/ceramic heating element 422 can form a floor surface of the warming drawer module 404, such as a warming surface for supporting (e.g., directly supporting) items to be warmed. The heating element 422 can be supplied with power from a power source and controlled by the control panel 412 to selectively provide one or more predetermined temperatures for the warming area in the warming drawer module or the floor surface of the warming drawer module. Exemplary embodiments of a heating element is described in greater detail with reference to FIG. 8. The warming drawer module 404 can be, for example, slidably deployable from within the warming drawer housing 402 using various arrangements of various types of drawer slides.

With reference again to FIGS. 5 and 6, the warming drawer module can be configured without sidewalls (e.g., without a left-hand sidewall or right-hand sidewall) connecting the front panel 406 to the rear panel 418, thereby improving and simplifying a user's access to the warming area, and particularly to the heating element 422, for example, for loading and unloading plates, cookware, cutlery, and/or food into and out of the warming drawer module 404. In other embodiments, the warming drawer can include a left-hand sidewall or a right-hand sidewall connecting at least one side of the front panel 406 to the rear panel 418. In still other embodiments, the warming drawer can include a left-hand sidewall and a right-hand sidewall connecting both sides of the front panel 406 to the rear panel 418. In another embodiment, the warming drawer module 404 can include only the front panel 406 without a left-hand sidewall, right-hand sidewall, or rear panel 418. The frame 416 and optional rear panel 418 and/or side panels can be, for example, stainless steel panels.

As shown in FIGS. 5 and 6, the exemplary warming drawer module 404 can be movable in a direction (shown by an arrow in the exploded view of FIG. 5) from a first position (e.g., a stored position as shown in FIG. 4) within the warming drawer housing 402 to a second position, such as a deployed position (e.g., as shown in FIG. 6) that is at least partially outside of the warming drawer housing 402 and that permits access to an interior of the warming drawer module 404 (e.g., access to the glass/ceramic heating element 422) or access to concealed controls (if equipped) (e.g., 412) of the warming drawer module 404, as exemplarily illustrated in FIGS. 5 and 6. The deployed position can include various partially or fully deployed positions of the warming drawer module 404 with respect to the warming drawer housing 402 and is not limited to the illustrated positions in the Figures.

As shown in FIGS. 5 and 6, the exemplary warming drawer module 404 can include one or more functional components (e.g., heating element 422, electrical wires 428, and/or control components 412) of the warming drawer 400 such that one or more of these functional components move with the warming drawer module 404 between the first position and the second position. The controls of the warming drawer 400 can be disposed on (i.e., on-board) the warming drawer module 404 such that the controls 412 are accessible when the warming drawer module 404 is in a deployed position and concealed by the appliance housing or another door on the appliance housing when the warming drawer 400 is in the first (i.e., closed) position. In other embodiments, the controls can be electrically connected to the warming drawer module 404 but remotely located from the warming drawer module 404, such as on the warming drawer housing 402, the housing (102 in FIG. 2) of the appliance 100, the control panel (106 in FIG. 2) of the appliance 100, etc.

The exemplary warming drawer module 404 can be movable further in the direction shown in FIG. 5 from the first position to a third position in which the warming drawer module 404 is removed completely from the warming drawer housing 402, such that the functional components (e.g., all of the functional components) of the warming drawer 400 are accessible to a user or a repair technician.

With reference to FIG. 6, an exemplary warming drawer module 404 is illustrated in a deployed position (e.g., a fully deployed position). The warming drawer module 404 can include one or more slides 424 for facilitating movement of the warming drawer module 404 (including the functional components, such as the heating element 422) between the stored position in the warming drawer housing 402 and the deployed position outside of the warming drawer housing 402. The slides 424 can be coupled, for example, directly to a part of the warming drawer housing 402, such as the floor for the warming drawer housing 402. The warming drawer module 404 optionally can include means for increasing the rigidity and stiffness and reducing deflection of the warming drawer module 404, such as one or more channels or supports 426 (shown with dashed lines) (e.g., channels or supports having a U-shaped, I-shaped, T-shaped, L-shaped, square-shaped, rectangular-shaped, circular-shaped, or oval-shaped cross-section) to increase the rigidity of the warming drawer module 404, stiffen the slide mounting, reduce deflection of a part of the warming drawer housing 402 or the warming drawer module 404, etc., particularly when the warming drawer module 404 is in a deployed position and/or in a loaded position. A drawer slide 424 can be coupled to the frame 416 of the warming drawer module and to the channels 426, which in turn can be coupled to the warming drawer housing 402 at one or more locations (e.g., floor, sidewall, rear wall, and/or frame of the warming drawer housing 402). In this way, the warming drawer module 404 can be coupled to the warming drawer housing 402 via one or more channels 426.

As shown in FIG. 6, a channel 426 can include one or more locking features or means for securing the channel 426 to the warming drawer housing 402, for example, one or more protrusions 432 on an end of the channel that engage an opening 434 in a rear panel 402*c* of the warming drawer housing 402. The locking feature or means can include one of more openings (not shown) formed in a portion of a front end of the channel 426 for receiving a fastening device and securing the front end of the channel 426, or another portion of the channel 426, to a part of the warming drawer housing 402 that can be easily accessed by a user or technician from a front area of the warming drawer 400 without removing the warming drawer module 404 or warming drawer housing 402.

The warming drawer module 404 can include a cable harness 428 for guiding one or more electrical wires or cables and/or data wires or cables to one or more components or parts of the warming drawer module 404, or one or more individual or bundled wires and/or cables. One or more of the wires or cables can include an electrical connection 430 that is electrically coupled to an electrical connection 130 of the household appliance 100, such as an electrical connection to a power supply connection, data connection, or control connection of the household appliance 100. The electrical connection 130 can be mounted in an opening 436 in the rear panel 402*c* of the warming drawer housing 402, as shown in FIG. 6. The warming drawer module 404 also can include cable routing or management devices such that users or repair technicians do not need to route wires or cables when installing and/or removing/repairing the functional parts of the warming drawer module 404. For example, the cable harness 428 can be coupled to one or more of the channels 426 at one or more locations using one or more coupling devices 438 (e.g., cable ties, clamps, or the like) to prevent snagging or kinking of the cable harness 428 and/or wires/cables during movement of the warming drawer module 404 in and out of the warming drawer housing 402. The cable harness 428 can be provided with a freely bendable and movable portion 428*a* having sufficient length (e.g., slack) to permit the moveable portion of the warming drawer module 404 to move in and out of the warming drawer housing 402 between the stored position and the deployed position without disconnecting the electrical, data, or power supply connection (e.g., 430) of the warming drawer module 404 from the corresponding electrical connection 130 of the warming drawer housing 402.

As shown in FIG. 6, many or all of the functional components of the warming drawer 400, such as the glass/ceramic heater element 422 and controls 412, can be on the movable portion of the warming drawer module 404 such that the functional components move with the movable portion of the warming drawer module 404 in and out of the warming drawer housing 402.

Figure 7:
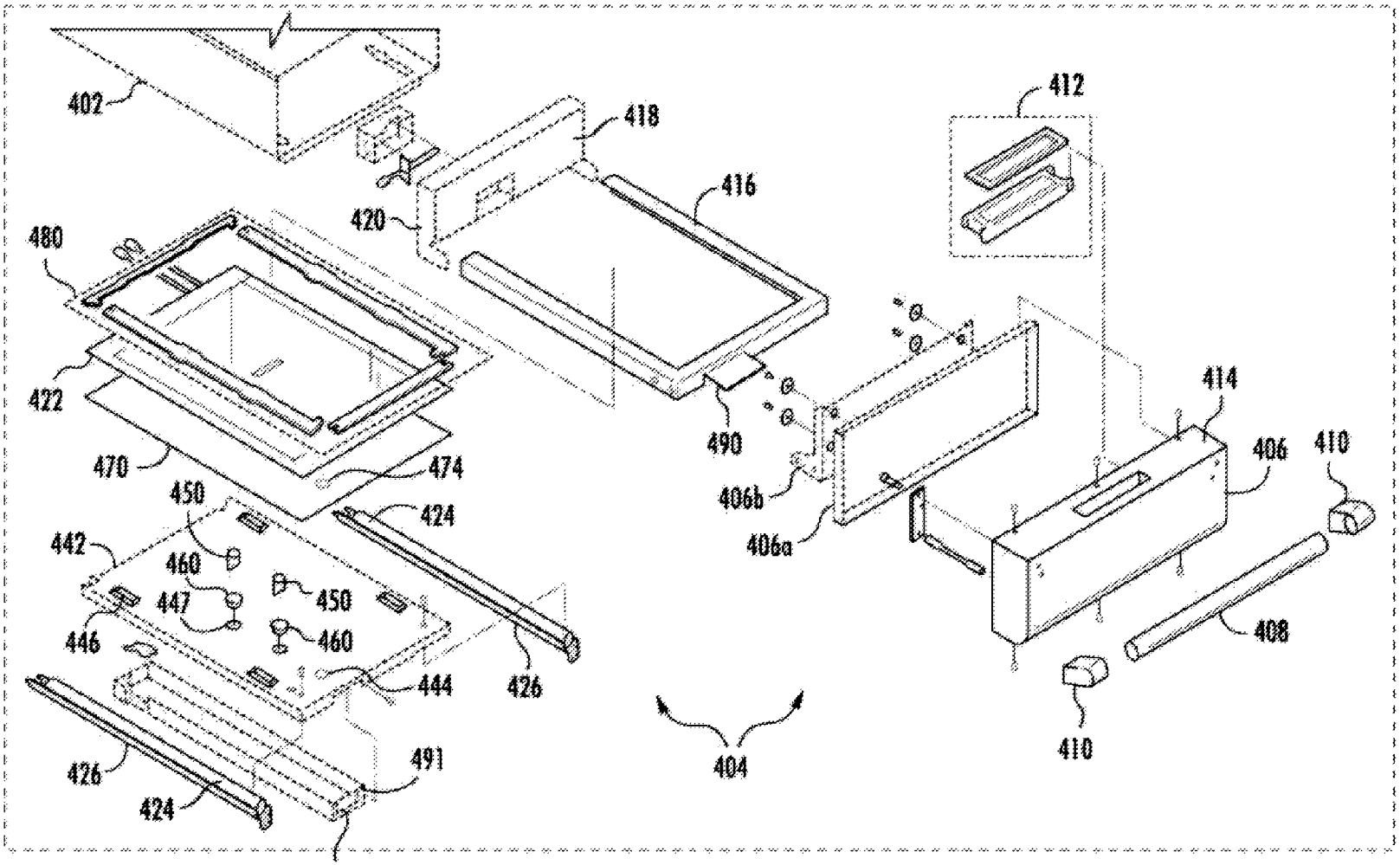
FIG. 7 is an exploded, perspective view of a warming drawer according to an exemplary embodiment of the invention.

With reference to FIG. 7, an exemplary embodiment of a warming drawer 400 will now be described in greater detail.

The exemplary warming drawer 400 can include, for example, a warming drawer housing 402 and a warming drawer module 404, shown in an exploded view. The warming drawer module 404 can include a front panel 406 having a handle 408 coupled to the front panel 406 via handle mounts 410. The front panel 406 can include a control panel 412 disposed in an opening or recess in an upper surface 414 of the front panel 406. The front panel 406 can include a rear portion 406*a* that encloses a rear side of the front panel 406 and a bracket 406*b* for coupling the rear portion 406*a* to a front portion of a frame 416 of the warming drawer module 404. A rear portion of the frame 416 can be coupled to a rear panel 418 via bracket portions 420 (which may be formed separately or integrally with the rear panel 418).

As explained above, the warming drawer 400 can include a heating device assembly including a ceramic/glass heating element 422, which is described in greater detail with reference to FIG. 8. The ceramic/glass heating element 422 forms the floor of the warming drawer module 404, and thus, will be directly loaded with plates, cookware, cutlery, food, etc. To support an underside of the ceramic/glass heating element 422, a support plate 442 (e.g., stainless steel support plate) can be provided to support the glass heating element 422. The support plate 442 can include one or more supporting features, such as a plurality of embosses 446, for supporting the glass heating element 422 a predetermined distance above the support plate 442 and minimizing thermal and electrical contact areas between the heating element 422 and the support plate 442. Exemplary embodiments of a support plate having embosses is described in greater detail with reference for FIGS. 9A-11D. The support plate 442 also can include one or more openings 447 for receiving one or more thermostat retainers 460 that support and fix one or more thermostats 450 in a predetermined position and height above the surface of the support plate 442 and against the underside of the glass heating element 422.

A thermally conductive sheet 470 having low thermal resistance and high electrical resistance qualities can be disposed over the entire support plate 442, or at least the contact points between the plurality of embosses 446 and the thermostats 450 and the conductive underside of the glass heating element 422. In other embodiments, individual portions of thermally conductive tape (not shown) can be provided locally at each location of the embosses 446 and/or thermostats 450. The thermally conductive sheet 470 or thermally conductive tape can include, for example, UL (Underwriter Laboratories) listed silicone electrically insulating material. The glass heating element 422 can be disposed directly on the thermally conductive sheet 470 and supported by the plurality of embosses 446 under the sheet 470.

An upper edge or perimeter surface of the glass heating element 422 can be covered by one or more gasket strips 480 for spills or liquids. The frame 416 can be disposed over the gasket strips 480 and the glass heating element 422, and then secured to the support plate 442, thereby keeping spills or other liquids away from electrical components in the module 404. The rear panel 418 may be disposed over a rear strip of the gasket strips 480. In this way, the glass heating element 422 can form both a floor surface of the warming drawer module 404 and the heating surface of the warming drawer module 404, thereby providing uniform heating of the items in the warming drawer module 404, and such that the items to be warmed can be placed directly on the glass heating element 422 when the warming drawer 404 is deployed.

As shown in FIG. 7, the support plate 442 can include a wire guide 491 coupled to an underside of the support plate 442 for guiding one or more wires or cables from for example the thermostats 450, the heating element 422, or other electrical components to the interior of the front panel 406 and the control panel 412. The support plate 442 and the thermally conductive sheet 470 can include corresponding openings to permit the electrical leads from the glass heating element 422 to pass through the support plate 442 and the thermally conductive sheet 470 to the wire guide 491. The frame 416 optionally can include a drip guard 490 to protect an electrical connection 489 from spills. For example, the drip guard 490 can guide spills, cleaning solutions, etc. from the upper surface of the glass heating element 422 and the frame 416 away from and around a first electrical connector (such as a first wiring harness connector 489) on the support plate 442, which may be disposed at an open end of the wire guide 491, and a second electrical connector (such as a second wiring harness connector; not shown) in the front panel 406 that leads to the control panel 412, and/or away from other electrical components above or below the support plate 442 or on the glass heating element 422.

As explained above, the warming drawer module 404 and the functional components are movable in and out of the warming drawer housing 402. In the embodiment of FIG. 7, a pair of slides 424 can be coupled to the support plate 442, and particularly, for example, to the underside of the support plate 442. The channel 426 can be coupled to the slides 424 to complete the warming drawer module 404. One of ordinary skill will recognize that the warming drawer module 404 is not limited to particular features and arrangement shown in FIG. 7 and additional or alternative parts, components, and arrangements may be included in the warming drawer module 404 within the spirit and scope of the invention.

Figure 8:
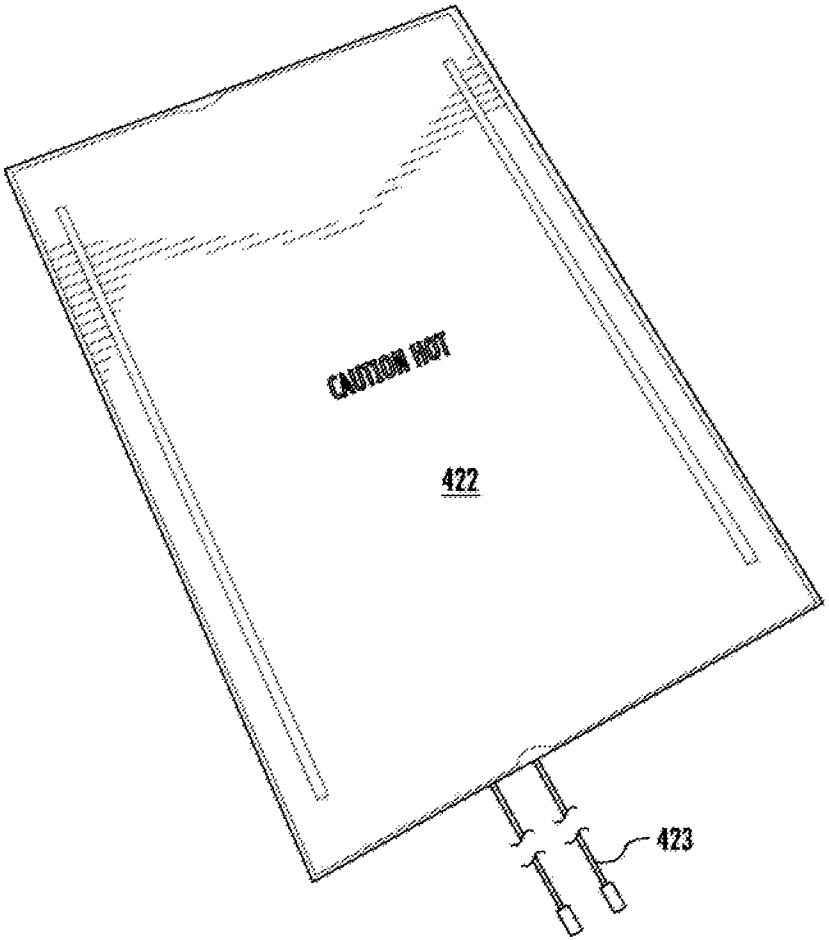
FIG. 8 is a perspective view of a heater device according to an exemplary embodiment of the invention.

With reference to FIG. 8, an exemplary heating device for a warming drawer module will now be described.

An exemplary heating device can include, for example, a ceramic/glass heating element 422 forming a floor surface of the warming drawer module for supporting the items to be warmed, such as food, plates, cookware, cutlery, etc. The heating element 422 can be a resistance heating element, for example, that operates similar to a rear window defroster of an automobile. The glass heating element 422 can include a glass ceramic surface having a plurality of heating element conducting paths or a uniform conductive coating (e.g., a clear, even conductive coating), for example, a 780 W element, thereby providing quick and even heating of items in the warming drawer module. More particularly, the underside of the ceramic/glass heating element 422 can include a thin metal layer or "conductive" coating (e.g., a clear, even conductive coating) that can generate heat evenly across the entire surface when provided with an electric current supplied, for example, by one or more power supply lines/wires/connectors 423. In the example, the entire surface can form a portion of an electric circuit such that the entire surface of glass/ceramic heating element 422 can generate heat (e.g., evenly generate heat). The ceramic/glass heating element 422 can provide uniform heat across an entire floor surface of the warming drawer module 404. The glass heating element can be easily cleaned, thereby reducing cleaning time and effort by the user for cleaning up spills, etc. from the floor surface of the warming drawer. The glass heating element 422 may include other features, such as a hot surface indicator (e.g., active indicator) for notifying a user or technician when the heating surface is hot, a passive warning for example painted on the glass surface, or an automatic shut-off timer to avoid overheating of the glass heating element 422 or reduce energy consumption in the event a user inadvertently fails to turn off the warming drawer, among other things.

With reference to FIGS. 9A-11D, exemplary embodiments of a support plate 442, which can support a glass/ceramic heating element 422 of the warming drawer module 404, will now be described.

As shown in FIG. 9A, an exemplary embodiment of a support plate 442 can include one or more support means (e.g., 446) for simply, easily, and inexpensively supporting an underside of the glass/ceramic heating element 422 such that the element 422 will not be damaged by items loaded on the glass/ceramic heating element 422 of the warming drawer module 404. The support means (e.g., 446) can minimize an amount of thermal and/or electrical contact area between the support means (e.g., 446) and the underside of the glass/ceramic heating element 422. For example, the support means (e.g., 446) can simultaneously minimize an amount of contact between that support means (e.g., 446) and the underside of the glass/ceramic heating element 422, which also may minimize heat transfer away from the glass/ceramic heating element 422 in a downward direction (i.e., in a direction away from the items to be warmed, which is an undesired direction for heat transfer), and which may minimize an amount of contact area of the support plate 442 that will need to be electrically insulated from the conductive underside of the glass/ceramic heating element 422. The support means (e.g., 446) also can control a height of the glass/ceramic heating element 422 above a surface of a support plate 442 (i.e., suspend the heating element 422 above the support plate 442) to provide a predetermined height or clearance for a thermostat 450 and thermostat retainer 460 to be disposed under the glass/ceramic heating element 422 and in contact with the underside of the glass/ceramic heating element 422. By controlling the height of the glass/ceramic heating element 422 above the surface of the support plate 442, the support means (e.g., 446) also can provide sufficient space for wire routing between the glass/ceramic heating element 422 and the metal support plate 442, for example, to route the wires 423 of the heating panel 422.

As shown in FIG. 9A, the exemplary support plate 442 can include one or more supporting means or features, such as a plurality of embosses 446 for supporting (e.g., evenly and distributively supporting) the underside of the glass/ceramic heating element 422 at a predetermined distance above the support plate 442, while also minimizing thermal and electrical contact areas between the heating element 422 and the support plate 442. The plurality of supports (e.g., embosses 446) can be disposed in various arrangements, patterns, and distributions on the support plate 442 to support the heating element 422 depending on the size and shape of the heating element 422. For example, in FIG. 9A, the support plate 442 can include four (4) embosses 446, each emboss 446 being disposed adjacent to a respective corner of the support plate 442. The embosses 446 can be evenly spaced with respect to each other such that the embosses 446 provide equal support for each of the edges of the glass heating element 422 near the corners of the heating element 422, and particularly, for example, in areas in which the frame 416 will clamp down on the glass heating element 422 during assembly, thereby reducing or preventing damage to the glass/ceramic heating element 422, for example, during assembly of the warming drawer module 404. The examples of the supports are described herein with reference to the exemplary embosses 446. However, one of ordinary skill in the art will recognize that the supports are not limited to the exemplary embosses and other types of supports or support structures can be provided to support the heating element in the desired position and to perform the desired support functions.

With reference again to FIG. 9A, the support plate 442 can include a metal support plate, such as a stainless steel support plate or other suitable heat resistant material, that is capable of being embossed using an emboss tool. In this way, the embosses 446 can be formed easily and inexpensively on the surface of the support plate 442 with precision and consistency in the manufacturing process. The dimensions (e.g., height) of each emboss 446 can be easily controlled using common manufacturing processes. In other embodiments, the support plate 442 can be formed from other materials such as, for example, other heat resistant materials that are capable of being formed by embossing, casting, or molding processes.

The support plate 442 can include one or more openings 447 for receiving one or more thermostat retainers 460 that support and fix one or more thermostats 450 in the space provided by the embosses 446 and in a predetermined position and height above the surface of the support plate 442 such that the thermostat 450 is against the underside of the glass heating element 422. The support plate 442 can include one or more tabs 448 and/or one or more openings or slots 449 for engaging a rear portion and/or front portion of the drawer slides (424; not shown in FIG. 9A). The support plate 442 can include one or more openings 444, for example, for guiding the wires 423 (e.g., power supply lines, control lines, and/or electrical connectors) of the glass/ceramic heating element 422 from the space provided by the embosses 446, for example, to the wire guide 491. The embosses 446 can control a height of the glass/ceramic heating element 422 above a surface of the support plate 442 to provide a predetermined height or clearance for routing the wires 423 between the glass/ceramic heating element 422 and the metal support plate 442. A grommet (not shown) can be provided in the opening 444 to protect the wires 423 from damage or wear from contacting an edge of the opening 444.

FIG. 9B shows an enlargement of an exemplary emboss 446 in FIG. 9A. The emboss 446 can include, for example, an upper surface 446*a* (e.g., having a substantially horizontal planar surface or a rounded surface) for supporting the underside of the glass/ceramic heating element 422, a plurality of side surfaces 446*b* (e.g., tapered or rounded side surfaces), and a plurality of tapered or rounded corners 446*c*. The planar, rounded, curved, and/or tapered surfaces can reduce or prevent damage to the underside of the heating element 422, for example, from sharp corners or edges. Moreover, the planar, rounded, curved, and/or tapered surfaces may distribute forces over a larger surface, thereby reducing or preventing damage to the heating element from concentrated forces. The emboss also can include one or more cuts or cutouts 446*d* formed along one or more sides (e.g., a longer side) of the emboss 446, for example, to permit the metal material to be embossed without affecting the surface of the support plate 442 surrounding the emboss 446 or to relieve stresses in the support plate 442 during the formation of the emboss 446, which may prevent deformation of the surface of the support plate 442 surrounding the emboss 446.

With reference to FIGS. 10A-10C, the embosses 446 of the support plate can have a variety of shapes and/or profiles that are capable of supporting the underside of the glass heating element 422.

When viewed from a side (e.g., in a direction parallel to a plane of the surface of the support plate and heating element), the emboss 446 can include, for example, a substantially planar, horizontal upper surface to distribute the forces between the emboss 446 and the underside of the heating element 422, as shown in FIGS. 10A-10C. In other embodiments, the side profile of the emboss 446 can have other shapes, such as a round shape. The emboss 446 can include angled, tapered, or rounded/curved corners and/or sides to protect the underside of the glass/ceramic heating element 422 from damage. In other embodiments, an emboss 446 can be separately formed in a single shape, or include a plurality of adjacent shapes, such as an emboss formed from a series of shapes, as shown, for example, in FIG. 10C. The present invention recognizes that a simple emboss tool, forming for example a simple shape, may be easier to fabricate than a more complex and/or less uniform shape, and also may provide more precision and consistency in the manufacturing process and the resulting dimensions (e.g., height) of the emboss 446.

Figure 11B:
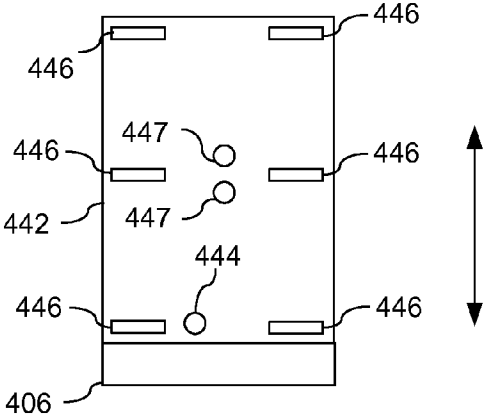
FIGS. 11A-11D are schematic plan views of support plates having embosses according to exemplary embodiments of the invention.
Figure 11D:
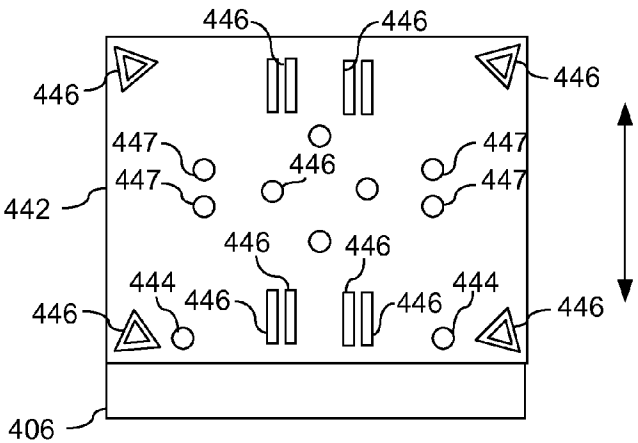
Figure 11A:
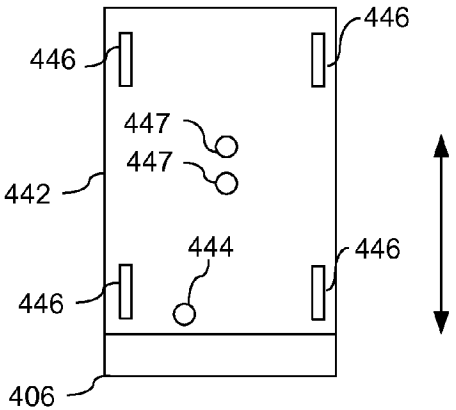

When viewed from above (i.e., in a direction normal to the surface of the support plate 442 and heating element 422), the embosses 446 can be, for example, rectangular-shaped embosses, square-shaped embosses, circular-shaped embosses, oval-shaped embosses, triangular-shaped embosses, among other shapes. FIGS. 11A and 11D illustrate exemplary embodiments of a support plate 442 having a plurality of embosses 446 for supporting the glass heating panel. FIG. 11A illustrates an arrangement similar to FIG. 9, in which the support plate 442 include four embosses 446 positioned, respectively, at each corner of the support plate 442. In this example, the embosses 446 are rectangular shaped embosses with a longer side of the emboss extending in a direction of deployment of the warming drawer, shown by the arrows. The longer side of the emboss also corresponds to the longer side of the support plate 442. In other embodiments, the longer side of the emboss may be perpendicular to the direction of deployment and corresponds to a shorter side of the support plate 442, as shown in FIG. 11B.

Figure 11C:
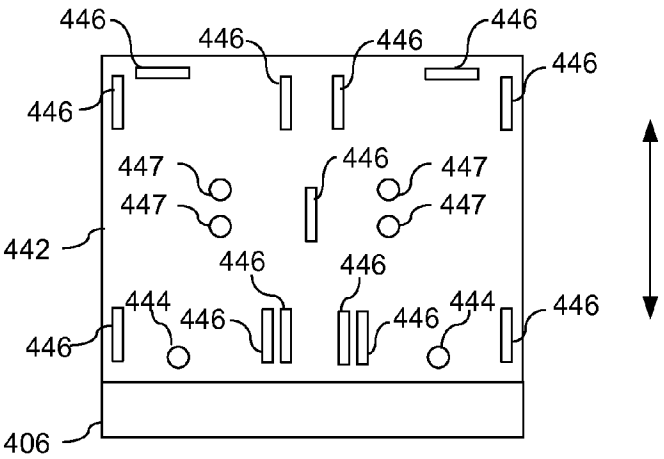

The support plate 442 can have various sizes depending on the size and configuration of the warming drawer 400. For example, the support plate 442 a width of the support plate 442 can be larger than a length of the support plate 442 in the deployment direction. The support plate 442 can include a variety of layouts of embosses to provide support for one or more heating elements. In the examples, the support plate 442 can be used with a single glass/ceramic heating elements 422 having a plurality of wires 423 (e.g., for a plurality of circuits formed on a single glass sheet) or with a plurality of glass/ceramic heating elements 422, for example, disposed in a side-by-side arrangement on the support plate 442. For example, as shown in FIG. 11C, the support plate 442 may have a plurality of openings 444 for receiving wires from one or more heating panels and openings 447 for receiving a plurality of thermostat retainers and thermostats. The embosses can extend in the same direction or in different directions. As shown in FIGS. 11A-11D, the embosses 446 can have the same shape or different shapes on the same support plate 442.

In some instances, the warming drawer may have a first side that is substantially longer than a second side such that the heating element 422 may flex in the middle when supporting items such as food, plates, etc., in a loaded state. As shown in FIGS. 11A-11D, the embosses 446 can be positioned along the edges, at or near a midpoint of a length of an edge, at a central location, and/or in other locations to provide sufficient support for the particular size and shape of warming drawer and support plate 442.

Figure 12B:
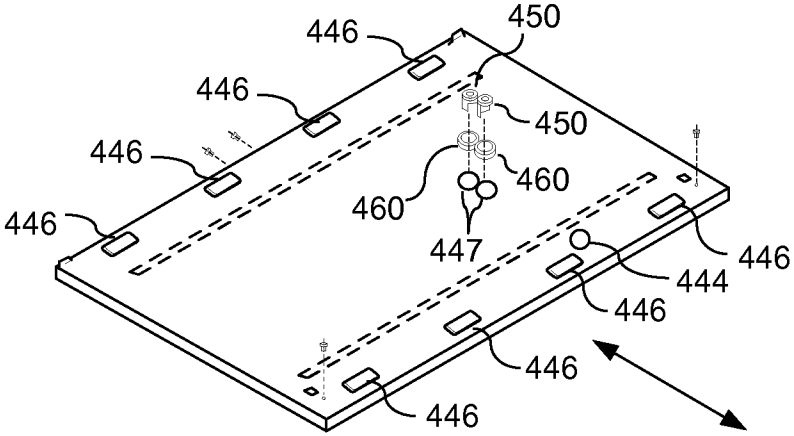
FIGS. 12A and 12B are a schematic plan view and a perspective view, respectively, of support plates having embosses according to exemplary embodiments of the invention.
Figure 12A:
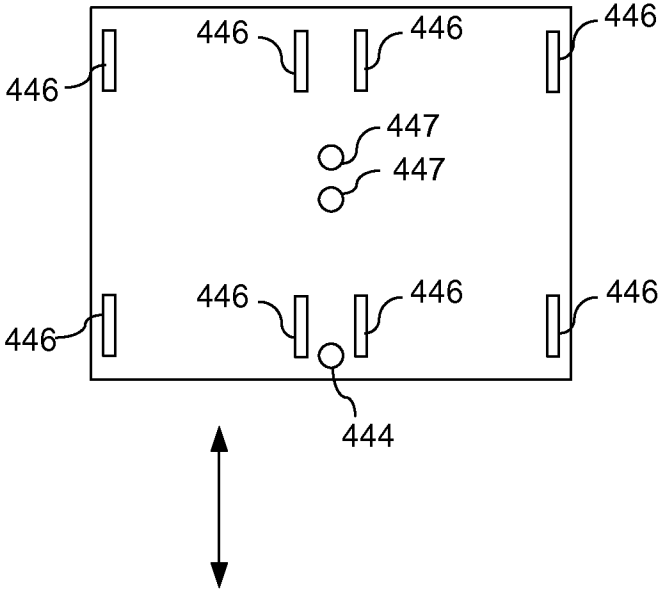

The embosses may be symmetrically arranged with respect to each other or to the support plate 442. In other embodiments, for example as shown in FIG. 12A, the embosses may be symmetrically arranged with respect to the openings 444 or 447. In still other embodiments, for example, as shown in FIG. 12B, the embosses may be non-symmetrically arranged with respect to the openings 444 or 447.

Figure 13A:
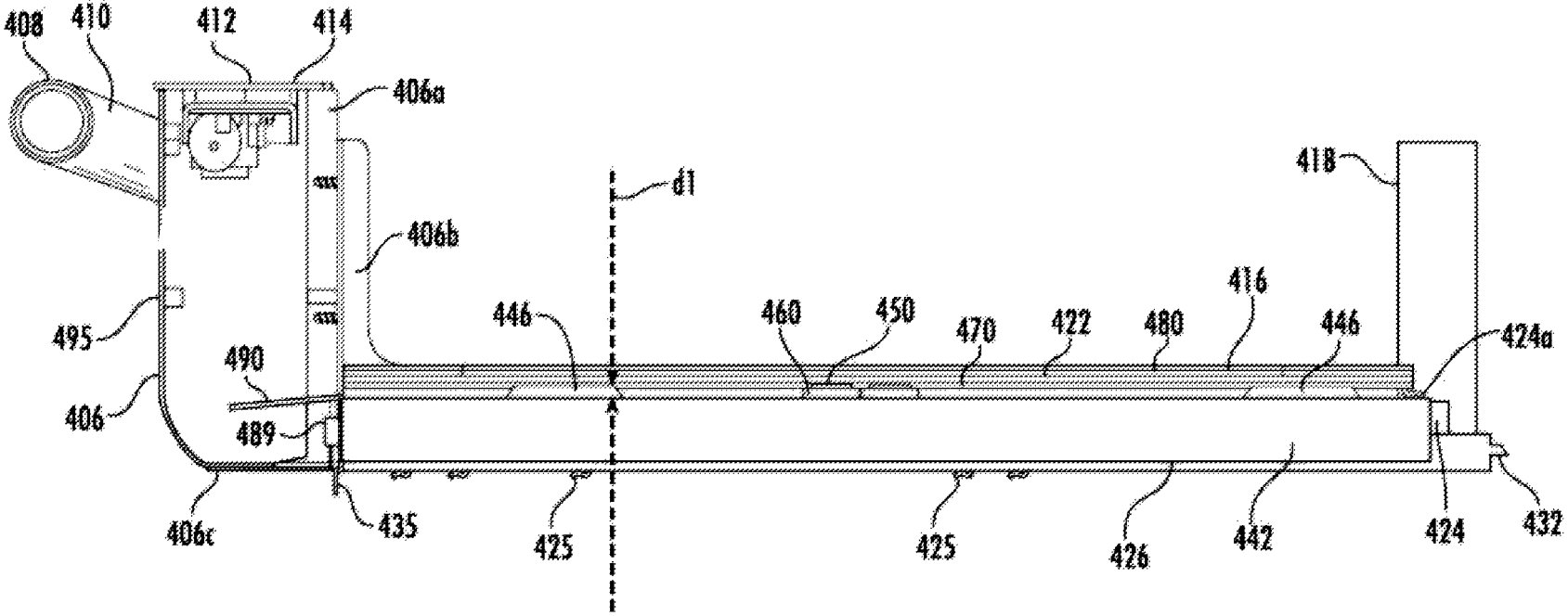
FIG. 13A is a schematic, cut-away side view of a warming drawer assembly
Figure 13B:
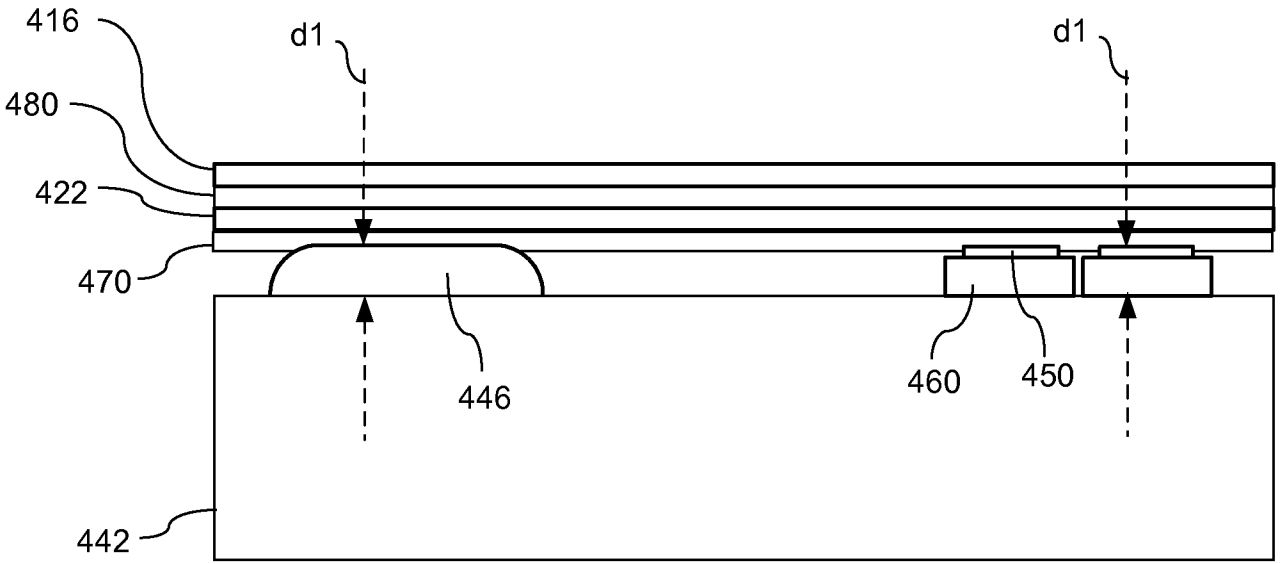
FIG. 13B is a schematic, cut-away partial side view of a warming drawer assembly according to an exemplary embodiment of the invention.

FIG. 13A illustrates a side, cut-away view of an assembled warming drawer module 404 according to the exemplary embodiment illustrated in FIG. 7. FIG. 13B is an enlargement of a partial side view of FIG. 13A.

As shown in FIG. 13A, the assembled warming drawer module 404 can include a front panel 406 having a handle 408 coupled to the front panel 406 via handle mounts 410. The front panel 406 optionally can include a control panel 412 disposed in an opening or recess in an upper surface 414 of the front panel 406, and as another option, one or more indicator lights 495 (e.g., an LED indicator light) on a front surface of the front panel 406 to indicate when the warming drawer 400 is in operation, when the heating element is hot, etc. The front panel 406 can include a rear portion 406*a* that encloses a rear side of the front panel 406 and a bracket 406*b* for coupling the rear portion 406*a* to a front portion of a frame 416 of the warming drawer module 404. A rear portion of the frame 416 can be coupled to a rear panel 418 via brackets (not shown in FIG. 13A).

A drawer slide 424 can be coupled to a support plate 442 (e.g., stainless steel support plate), and particularly, for example, to the underside of the support plate 442. In the illustrated example, the slide 424 can include one or more projections 424*a* that engage corresponding openings (not shown in FIG. 13A) in the support plate 442. The channel 426 can be coupled to an underside of the slide 424. For example, the slide 424 can include one or more projections 425 on an underside of the slide 424 that engage corresponding openings in the U-shaped channel 426. FIG. 13A shows the locking feature 432 at a rear portion of the U-shaped channel 426 that engages or locks into a corresponding locking features (not shown) in the rear wall of the warming drawer housing, and a front portion 435 of the U-shaped channel 426 that can be secured (for example, with one or more screws) to a portion of the warming drawer housing at a location that is accessible to a user or technician from the front of the appliance in order to facilitate easy removal and replacement of the warming drawer module 404 for repairs, replacement, modifications, and/or cleaning of the warming drawer module 404.

As shown in FIGS. 13A and 13B, the exemplary warming drawer 400 can include a glass heating element 422 supported by a plurality of embosses 446 formed on the support plate 442. The glass heating element 422 can be supported by a plurality of embosses 446 at a predetermined distance d1 above the support plate 442, thereby minimizing thermal and electrical contact areas between the heating element 422 and the support plate 442. The wires (not shown) of the heating element 422 can be guided in the space between the upper surface of the support plate 442 and the underside of the glass heating element 422.

The warming drawer 400 can include one or more thermostat retainers 460 that support and fix one or more thermostats 450 such that a portion of each retainer 460 and the sensor of each thermostat 450 is disposed within the predetermined distance d1 between the upper surface of the support plate 442 and the underside of the glass heating element 422, which is provided by the embosses 446. The predetermined distance d1 can be selected to correspond to the particular height of the assembly of the thermostat retainer 460 and thermostats 450 to ensure that the sensor of the thermostat 450 obtains sufficient conductive contact with the underside of the heating element 422 to provide accurate temperature measurements of the true temperature of the heating element 422.

As shown in FIGS. 13A and 13B, a thermally conductive sheet 470 having low thermal resistance (i.e., high thermal conductivity) and high electrical resistance qualities can be disposed over the entire support plate 442, including the contact points between the plurality of embosses 446 and the conductive underside of the glass heating element 422, and the contact points between the thermostats 450 and the conductive underside of the glass heating element 422. Each thermostat retainer 460 can support the sensor of the thermostat 450 in a predetermined position above the upper surface of the support plate 442 (for example, at a height that meets government and agency minimum electrical clearance requirements) such that the thermostat 450 is pressed upward against the underside of the glass heating element 422 when the warming drawer module 404 is in an assembled state. As shown in FIG. 13B, the thermally conductive sheet 470 can be disposed in a state of compression between the thermostat 450 and the underside of the glass heating element 422, which may improve thermal contact between the thermostat 450 and the underside of the glass heating element 422. In other exemplary embodiments, individual portions of thermally conductive film or tape can be provided locally at each location between the embosses 446 and/or thermostats 450 and the underside of the glass heating element 422. The thermally conductive sheet 470 or thermally conductive tape can include, for example, UL (Underwriter Laboratories) listed silicone electrically insulating material.

With reference again to FIGS. 13A and 13B, the glass heating element 422 is disposed over the thermally conductive sheet 470, the plurality of embosses 446 of the support plate 442, and the thermostats 450. An upper edge or perimeter surface of the glass heating element 422 can be covered by one or more gasket strips 480 for spills or liquids, which may form a gasket or seal between the glass heating element 422 and the frame 416. The frame 416 can be disposed over the gasket strips 480 and the glass heating element 422, and then secured to the support plate 442, thereby keeping spills or other liquids away from electrical components in the module 404.

In this way, the exemplary embodiments can provide simple, easy to manufacture, and inexpensive support means (e.g., 446) for providing sufficient support underneath a ceramic/glass heating element (e.g., 422) to minimize or prevent damage to the ceramic/glass heating element and simultaneously minimize a contact area between the ceramic/glass heating element and the support means, which correspondingly can minimize heat transfer away from the ceramic/glass heating element (toward the support plate) and minimize an amount of insulation needed to insulate the contact area between the underside of the glass/ceramic heating element and the support plate (e.g., 442).

In other embodiments, a household appliance can include a warming drawer with a fixed glass heating element. The warming drawer can include a support plate (e.g., 442) having support means (e.g., a plurality of embosses 446) supporting an underside of the heating element at a predetermined distance above the support plate.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A household appliance comprising:

a warming drawer housing having an interior chamber; and a warming drawer module in the interior chamber, the warming drawer module including:

a heating element forming a floor surface of the warming drawer module, the floor surface for receiving items to be warmed; and a support plate that supports the heating element in a position above the support plate, the support plate including a plate portion and a plurality of supports on the plate portion, the plurality of supports supporting an underside of the heating element at a predetermined distance above the plate portion.

2. The household appliance of claim 1, wherein the warming drawer module is movable between a first position in which the warming drawer module is in the interior chamber of the warming drawer housing and a second position in which a part of the warming drawer module is outside the warming drawer housing.

3. The household appliance of claim 1, wherein the heating element includes a resistance heating element.

4. The household appliance of claim 1, wherein the heating element includes:

a glass ceramic surface having a conductive coating, the glass ceramic surface forming a warming surface that supports the items to be warmed, the conductive coating forming a circuit on an underside of the ceramic surface; and an electrical connection for supplying power to the circuit.

5. The household appliance of claim 1, wherein the plurality of supports includes an emboss, the emboss including:

an upper surface supporting the underside of the heating element; and a sidewall connecting the plate portion of the support plate to the upper surface of the emboss.

6. The household appliance of claim 5, wherein the upper surface is a substantially planar surface that is parallel to the underside of the heating element.

7. The household appliance of claim 5, wherein the upper surface is a substantially curved surface.

8. The household appliance of claim 5, wherein the sidewall is a substantially curved surface.

9. The household appliance of claim 1, wherein the plurality of supports includes a support having a substantially curved surface.

10. The household appliance of claim 1, wherein the plurality of supports includes a support having a tapered surface.

11. The household appliance of claim 1, wherein the plurality of supports includes a support having rounded corners.

12. The household appliance of claim 1, wherein the plurality of supports includes a plurality of embosses that are evenly spaced on the plate portion.

13. The household appliance of claim 1, wherein the plurality of supports includes a plurality of embosses that are symmetrically arranged with respect to the plate portion.

14. The household appliance of claim 1, wherein the plurality of supports includes a support formed along an edge of the plate portion.

15. The household appliance of claim 14, wherein the support is formed substantially at a midpoint of a length of the edge of the plate portion.

16. The household appliance of claim 1, wherein the plurality of supports includes a support formed adjacent to a corner of the plate portion.

17. The household appliance of claim 1, wherein the plurality of supports includes a support formed adjacent to a central point of the plate portion.

18. The household appliance of claim 1, wherein the plurality of supports includes an emboss and a cutout adjacent to a side of the emboss.

19. The household appliance of claim 18, wherein the cutout extends along a length of the side of the emboss.

20. The household appliance of claim 1, wherein the plurality of supports includes an emboss and a cutout adjacent to a first side and a second side of the emboss, the first side being opposite to the second side.

21. The household appliance of claim 1, wherein the plurality of supports are formed along a first edge and a second edge of the plate portion, the first edge being opposite to the second edge.

22. The household appliance of claim 21, wherein the plurality of supports includes a support formed substantially at a midpoint of a length of one of the first edge and the second edge of the plate portion.

23. The household appliance of claim 21, wherein the plurality of supports includes a support formed adjacent to a corner of the plate portion.

24. The household appliance of claim 21, wherein the plurality of supports includes a support formed adjacent to a central point of the plate portion.

25. The household appliance of claim 21, wherein the plate portion includes a third edge connecting an end of the first edge to an end of the second edge, one of the first edge and the second edge being longer than the third edge, wherein the plurality of supports includes an emboss having a first side and a second side, the first side being longer than the second side, and the first side of the emboss being substantially parallel to the one of the first edge and the second edge of the plate portion.

26. The household appliance of claim 21, wherein the plate portion includes a third edge connecting an end of the first edge to an end of the second edge, one of the first edge and the second edge being longer than the third edge, wherein the plurality of supports includes an emboss having a first side and a second side, the first side being longer than the second side, and the first side of the emboss being substantially perpendicular to the one of the first edge and the second edge of the plate portion.

27. The household appliance of claim 21, wherein the plate portion includes a third edge connecting an end of the first edge to an end of the second edge, one of the first edge and the second edge being longer than the third edge, wherein the plurality of supports includes an emboss having a first side and a second side, the first side being longer than the second side, and the first side of the emboss being disposed at a first angle to the one of the first edge and the second edge of the plate portion, the first side being other than parallel to and perpendicular to the one of the first edge and the second edge of the plate portion.

28. The household appliance of claim 1, wherein the plate portion includes a first opening for guiding a wire from the heating element from a space between the plate portion and the underside of the heating element to an underside of the support plate.

29. The household appliance of claim 1, wherein the plate portion includes a second opening for positioning a thermostat in a space between the plate portion and the underside of the heating element.

30. The household appliance of claim 1, wherein the plurality of supports includes an emboss, and wherein a height of the emboss is equal to the predetermined distance.

31. The household appliance of claim 1, further comprising:

a thermally conductive and electrically resistant layer disposed between the plurality of supports and the underside of the heating element, and wherein, when the warming drawer is in an assembled state, a sum of a height of a support of the plurality of supports and a thickness of the thermally conductive and electrically resistant layer is equal to the predetermined distance.

32. The household appliance of claim 1, wherein the support plate is a metal plate.

33. The household appliance of claim 1, wherein the support plate is a stainless steel plate.

34. The household appliance of claim 1, further comprising:

a control panel on the warming drawer module; and a power source coupled to the control panel, the power source supplying power to the control panel when the warming drawer module is in the first position and the second position.

35. The household appliance of claim 1, wherein the warming drawer module further includes:

a frame surrounding the heating element; and a front panel coupled to the frame and covering an opening of the interior chamber of the warming drawer housing when the warming drawer module is in the first position.

36. The household appliance of claim 1, wherein the warming drawer module further includes:

a telescopic drawer slide coupled to the support plate, the telescopic drawer slide facilitating the movement of the warming drawer module between the first position and the second position.

37. A household appliance comprising:

a warming drawer housing having an interior chamber; and a warming drawer module in the interior chamber, the warming drawer module including:

heating means for warming items to be warmed and forming a floor surface of the warming drawer module;

a support plate; and support means for supporting an underside of the heating means in the warming drawer module, and for providing a predetermined clearance distance under the heating means between the heating means and the support plate.

38. The household appliance of claim 37, wherein the support means includes:

a plurality of embosses formed on the support plate and supporting the underside of the heating element at the predetermined clearance distance above the support plate, the plurality of embosses for minimizing a contact area between the heating means and the support plate.

39. The household appliance of claim 37, wherein the warming drawer module is movable between a first position in which the warming drawer module is in the interior chamber of the warming drawer housing and a second position in which a part of the warming drawer module is outside the warming drawer housing.

* * * * *